United States Patent [19]

Igarashi et al.

[11] 4,086,857

[45] May 2, 1978

[54] SECTIONAL ASSEMBLY

[75] Inventors: Hitoshi Igarashi; Kenji Ekuan, both of Tokyo, Japan

[73] Assignee: Asahi Glass Company, Ltd., Tokyo, Japan

[21] Appl. No.: 766,974

[22] Filed: Feb. 9, 1977

[30] Foreign Application Priority Data

Mar. 3, 1976 Japan ..... 51-22773

[51] Int. Cl.[2] ..... A47B 57/00

[52] U.S. Cl. ..... 108/106; 108/111; 108/101; 211/187

[58] Field of Search ..... 108/111, 101, 157, 153, 108/60, 61, 106; 312/263, 264, 111, 140; 211/186, 187; 248/245

[56] References Cited

U.S. PATENT DOCUMENTS

| | | | |
|---|---|---|---|
| 638,253 | 12/1899 | Lehnbeuter | 312/140 |
| 810,857 | 1/1906 | Hallock | 312/140 |
| 876,617 | 1/1908 | Bierend | 312/140 |
| 3,327,657 | 6/1967 | Hauville | 108/111 X |
| 3,756,168 | 9/1973 | Bushyhead | 108/106 X |
| 3,901,164 | 8/1975 | Urti | 108/106 |
| 3,998,509 | 12/1976 | Hauser | 312/263 |

FOREIGN PATENT DOCUMENTS

| | | | |
|---|---|---|---|
| 696,333 | 10/1930 | France | 211/187 |
| 2,201,642 | 8/1973 | Germany | 312/111 |
| 2,016,266 | 10/1971 | Germany | 312/140 |
| 2,326,730 | 12/1974 | Germany | 108/111 |
| 522,244 | 6/1940 | United Kingdom | 211/187 |
| 1,163,813 | 9/1969 | United Kingdom | 108/60 |

*Primary Examiner*—Francis K. Zugel
*Attorney, Agent, or Firm*—Oblon, Fisher, Spivak, McClelland & Maier

[57] ABSTRACT

A sectional assembly for interior articles comprises vertically oriented glass plates which are departed in one direction and curved holding arms which have each connecting part at both ends for clamping an edge of each of the plates as a unit. The connecting part comprises a flange which is used for clamping said glass plate with a fitting and a bolt and nut without requiring formation of any holes in the glass plates. Horizontal glass plates are also provided which are supported by the curved holding arms.

11 Claims, 19 Drawing Figures

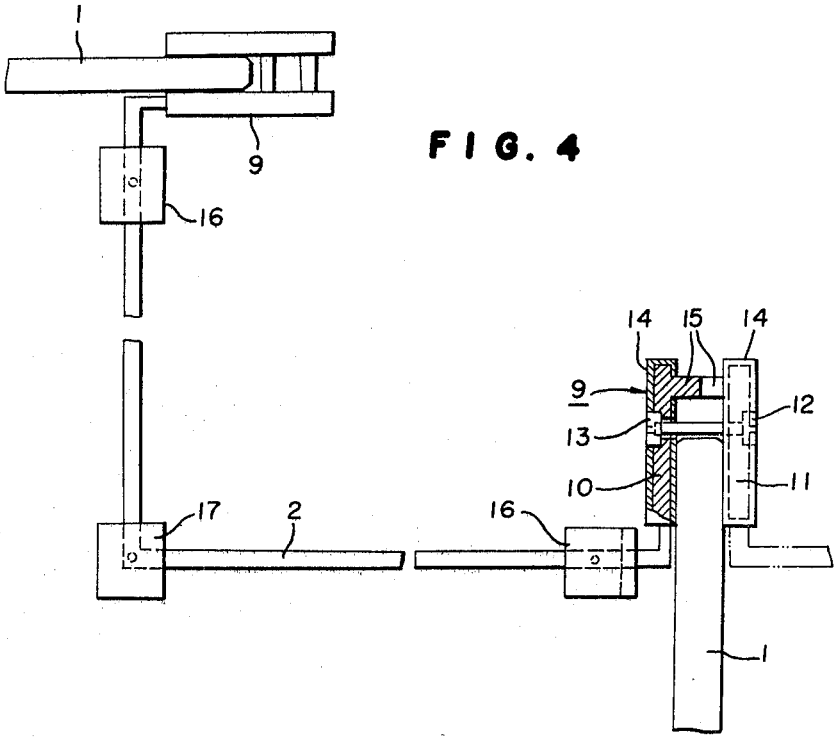
FIG. 4
FIG. 5
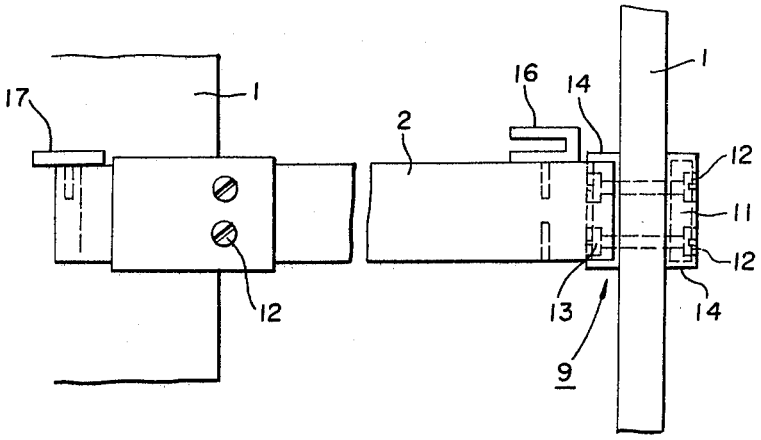

SECTIONAL ASSEMBLY

BACKGROUND OF THE INVENTION

1. Field of the Invention

The present invention relates to a sectional assembly for interior articles to form a hanger, a showcase, a table and a rack by assembling only a few kinds of parts.

2. Description of Prior Art

Heretofore, it has been necessary to bend or to temper glass plates or to prepare special fittings for preparing interior articles especially articles having glass plates whereby the cost for processing and assembling has been remarkably high and glass plates which are excellent substrate for interior decoration could not be used in desired positions.

SUMMARY OF THE INVENTION

It is an object of the present invention to provide a sectional assembly for interior articles which can be freely selected in structure for various spaces and which has low cost in manufacture and is easily arranged and has excellent see-throughness, and which can be formed by using standardized parts of glass plates and fittings whereby the processing and shaping of glass plates can be simplified and the number of kinds of the fittings can be minimized.

The sectional assembly for interior articles comprises two or more plates which are perpendicularly arranged with each gap and curved holding arms which have each connecting part at both of ends for clamping each edge of the plates.

The curved holding arms have connecting parts at both of ends for clamping plates and can be fixed at desired level of the plates which are perpendicularly arranged.

The curved holding arms can hold a plate for a shelf and accordingly, the sectional assembly can be used as the sectional shelves for disposing goods or showcase, and can be also used as a hanger without holding any plate.

The curved holding arms are arranged to clamp edges of the adjacent two plates, and a self-standing sectional assembly as an interior article can be formed by connecting three or more plates. It is possible to form a large sectional assembly for interior article by connecting units of the plates and the curved holding arms in series.

The plates as the elements of the sectional assembly of the invention can be ply-boards, plastic plates, metallic plates and the other, especially glass plates, since a see-through space can be formed by using glass plates.

BRIEF DESCRIPTION OF THE DRAWINGS

Various other objects, features and attendant advantages of the present invention will be more fully appreciated as the same becomes better understood from the following detailed description when considered in connection with the accompanying drawings.

FIG. 4 is a partially enlarged plan view of the curved holding arm;

FIG. 5 is a side view of the curved holding arm of FIG. 4;

DETAILED DESCRIPTION OF THE PREFERRED EMBODIMENTS

Figure 1:
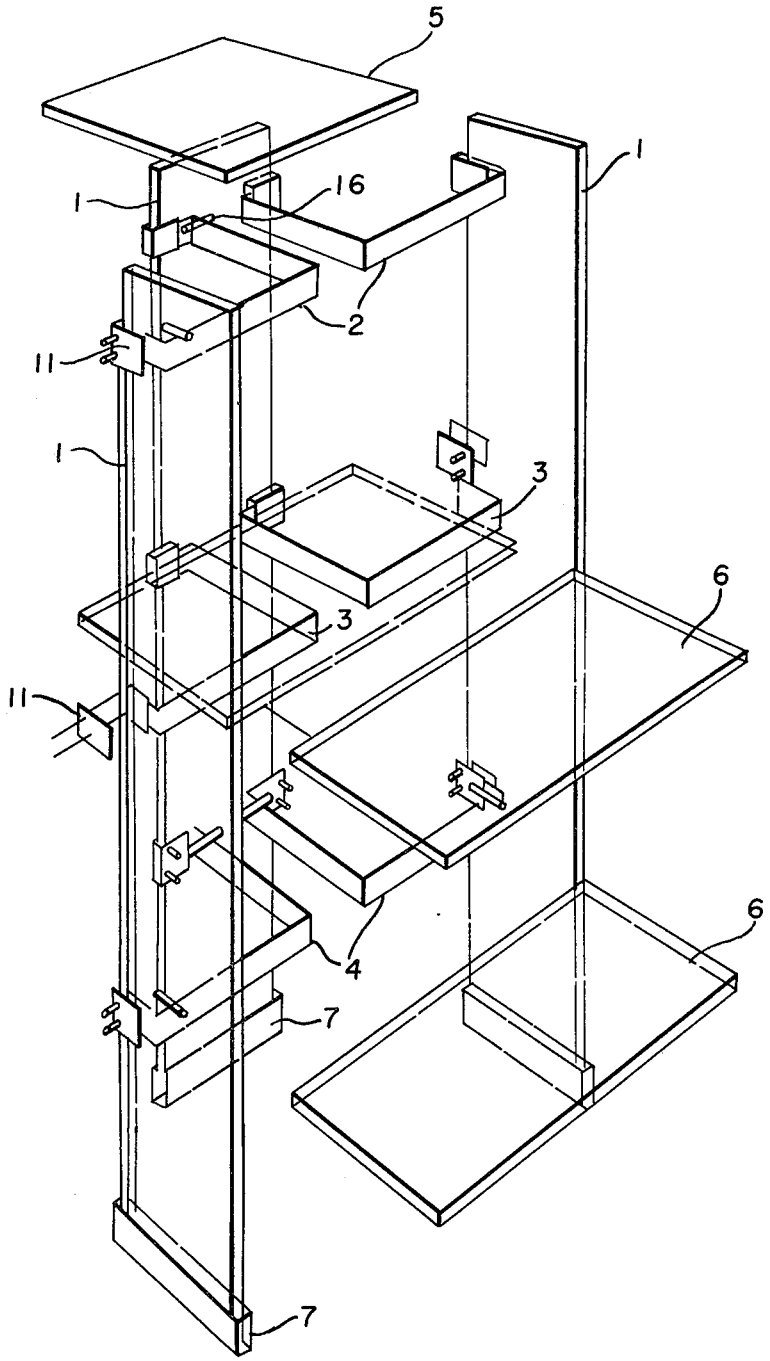
FIGS. 1 to 3 show schematic views of certain embodiments of the sectional assembly for interior articles according to the present invention.

Referring to the drawings, and more particularly to FIGS. 1 to 19, embodiments of the sectional assembly according to the present invention will be described.

In the drawings, like reference numerals designate identical or corresponding parts.

FIG. 1 is a schematic view of one embodiment of the sectional assembly of the assembled sectional shelves wherein three glass plates 1 are arranged to surround three sides and to open the front side.

Figure 9:
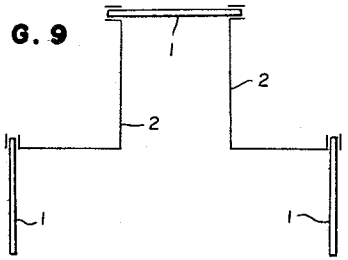
FIGS. 9 to 19 show schematic views of certain embodiments of assembly of the plates and the curved holding arms.

The arrangement of the glass plates 1 and the curved holding arms 2 for the embodiment of FIG. 1 is shown in FIG. 9. The three glass plates 1 respectively have the same shape and are separately arranged with each gap. The planes of the side glass plates are preferably in perpendicular to the plane of the central glass plate but may be oriented to form an angle of greater or less than 90°.

The edges of the glass plates are clamped by each pair of curved holding arms 2, 3, 4 in each level at the upper part, the middle part and the lower part. The curved holding arms 2, 3, 4 respectively have the same shape. A glass plate 5 having substantially square shape is disposed on a pair of the curved holding arms 2 at the upper part. Each of glass plates 6, 6 having rectangular shape is respectively disposed on each pair of the curved holding arms 3, 4 at the middle part and the lower part. The rectangular glass plate 6 has two times of the length of the square glass plate 5 in one side. These glass plates can be disposed as desired from the viewpoint of interior decoration. It is possible to hang or to put a display on the curved holding arm without holding a glass plate.

Each bottom of the vertical glass plates can be protected with a protector such as a frame plate 7. In the first embodiment of the assembled sectional sleeves, an illumination is used as desired to obtain excellent appearance of the articles in the space surrounded by the vertical glass plates.

Figure 2:
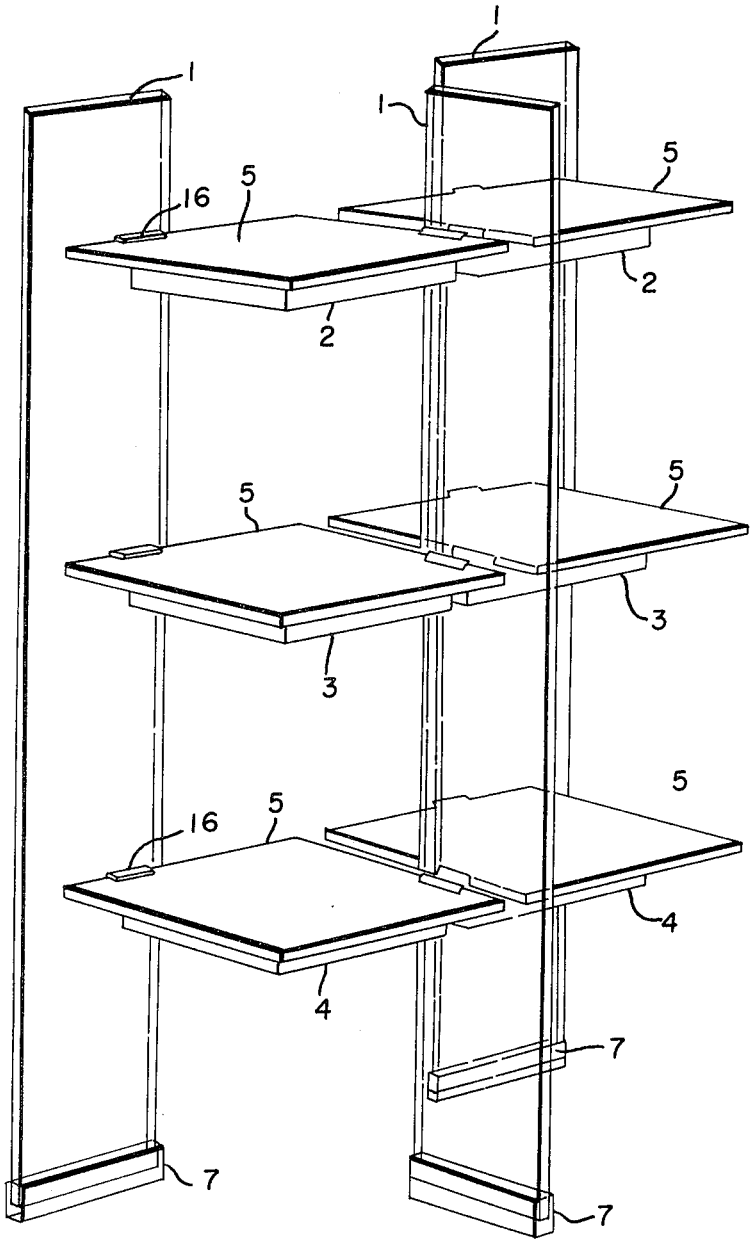
Figure 11:
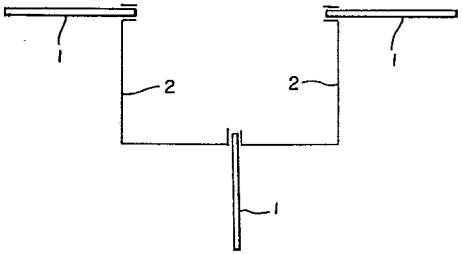

FIG. 2 is a schematic view of the assembled sectional shelves and FIG. 11 shows the arrangement of the glass plates 1 and the curved holding arms 2 for the embodiment of FIG. 2.

The three glass plates 1 are vertically arranged to give T shape planes. Each pair of the curved holding arms 2, 3, 4 are respectively connected at each edges at three levels. The pair of the curved holding arms are connected on the edge of one central glass plate from both sides with a common connector (clamp). The other end of each curved holding arm extended to right or left direction is connected to the edge of each vertical glass plate adjacent to the central glass plate. The same size glass plates 5 are respectively on the curved holding arms 2, 3, 4.

The curved holding arms are not always necessary to symmetrically arranged, but also to be alternatively arranged in different levels for the connections of the vertical glass plates. It is necessary to connect the adjacent vertical glass plates 1 at two or more than two levels.

In the preferable arrangement, the glass plates 1 are separately arranged in vertical direction. The second embodiment of the assembled sectional shelves has spaces for outwardly opening from the center of the central glass plate 1.

Figure 3:
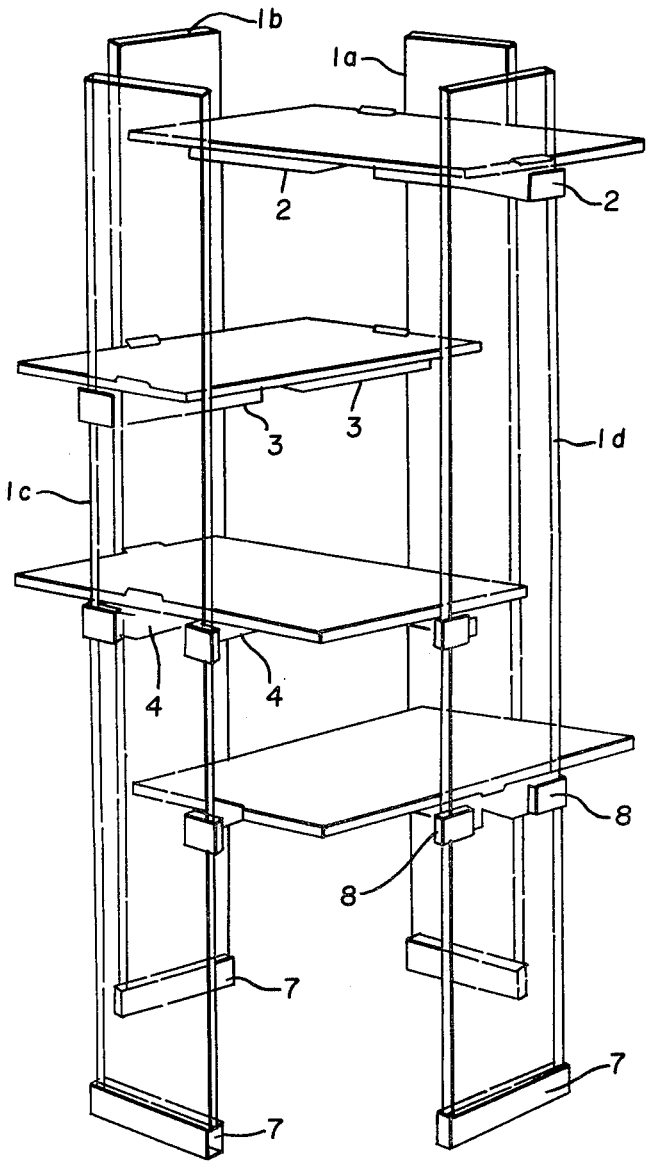
Figure 12:
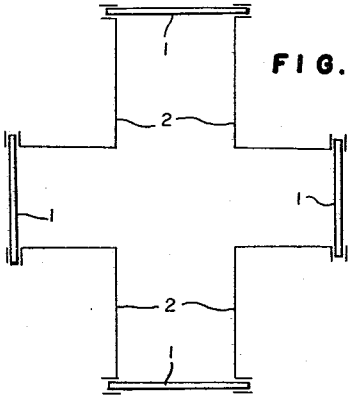

FIG. 3 is a schematic view of the assembled sectional shelves and FIG. 12 shows the arrangement of the glass plates and the curved holding arms 2 for the embodiment of FIG. 3.

Four glass plates 1 are arranged to form a square sectional view.

On the other hand, the curved holding arms 2 are respectively connected to clamp each edge of the glass plate 1*a* and each edge of the adjacent glass plates 1*b*, 1*d*. A pair of the curved holding arms 3 in the second level, are respectively connected to clamp each edge of the glass plate 1*b* and each edge of the adjacent glass plates 1*a*, 1*c*. A pair of the curved holding arms 4 in the third level, are respectively connected to the glass plate 1*c* and the adjacent glass plates 1*b*, 1*d*. A pair of the curved holding arms 8 in the lowest level, are respectively connected to the glass plate 1*d* and the adjacent glass plates 1*c*, 1*a*. Accordingly, the assembled shelves held by the curved holding arms 2, 3, 4, 8 are in spiral arrangement.

Thus, in the arrangement of the glass plates 1 in square, it is possible to connect two pairs of the curved holding arms in each level so as to hold two glass plates, on the pairs of the curved holding arms in each level. The curved holding arm can be used for hanging goods without holding a glass plate.

In accordance with the embodiment of the assembled shelves, goods can be displayed in the central part to show the goods from all sides.

The structure of the curved holding arm will be described.

The curved holding arms are made of material having enough strength for self-holding the glass plates 1 by mutual holding forces under connecting the adjacent glass plates 1 and for holding shelf plates (preferably glass plates) and goods put on them.

It is preferable to form the curved holding arm by die casting metallic melt, bending metallic strip, tube or the other rod or welding parts on the base.

The shape of the curved holding arm is preferably to have L-shape from the viewpoints of the stable holding of a shelf plate and the self-holding of the glass plates and the easy processibility.

Figure 6:
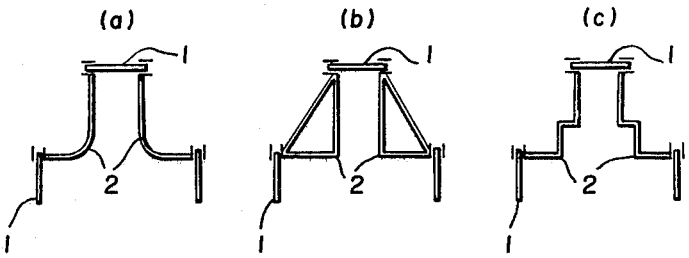
FIGS. 6*a* to 6*c* show schematic views of certain shapes of the curved holding arm.

However, the curved shape (FIG. 6*a*) the triangular shape (FIG. 6*b*) and the modified L-shape (FIG. 6*c*) can be formed in the curved holding arm as shown in FIG. 6 if desired.

In FIGS. 4 and 5, the holding arm 2 having L-shape has the connecting parts 9 at both ends. The connecting parts 9 comprises a flange 10 which is bent so as to provide the surface contact to the glass plate in perpendicular to the base of the holding arm 2, and a clamp fitting 11 corresponding to the flange 10 and bolts 12 and nuts 13 for connecting through holes formed on the flange 10 and the clamp fitting 11 and resilient piece 14 disposed at the contact between the glass plate and the flange 10 and the clamp fitting 11. (In the drawings, all surfaces are surrounded by the resilient piece). The gap for clamping the glass plate 1 is controlled by spacers 15, 15 which are projected from the flange 10 and the clamp fitting 11.

It is possible to use the other clamping mechanism for the connecting part 9. It is important to fix the glass plate by clamping at desired edge of the glass plate without forming any hole on the glass plate.

When the means for commonly connecting the central glass plate is used in the second embodiment of the invention, the flange of the other holding arm 2 is used instead of the clamp fitting 11 to clamp the glass plate 1 for connecting two flanges by the bolts 12 and nuts 13.

The holding arm 2 can have a hook 16 for holding a shelf plate under insertion. The hook 16 can be screwed to remove it from the holding arm when a shelf plate is not held and to use the holding arm in either right or left side.

The holding arm 2 can have detachable holder 17 for holding a glass shelf plate at the central part or the curved part.

Figure 7:
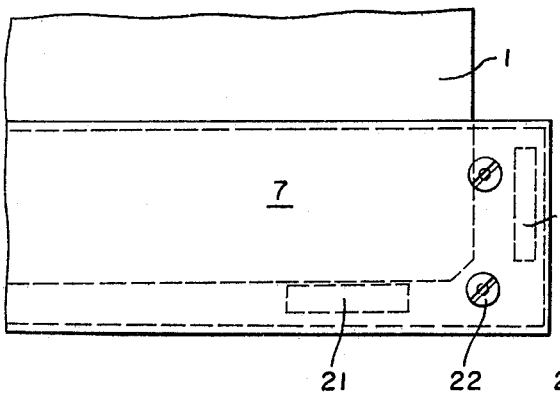
FIG. 7 is a partially enlarged view of the protector at the bottom.
Figure 8:
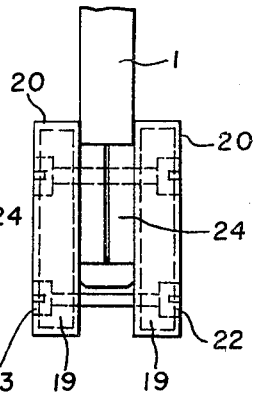
FIG. 8 is a side view of the protector of FIG. 7.

FIGS. 7 and 8 show one embodiment of protector 7 for protecting the glass plates 1 at the bottom.

The protector 7 comprises two plates 19 for holding the glass plate 1 under departing it from the earth; a resilient material 20 covering the plate 19 for protection; a holder 21 for holding the glass plate 1 under departing it from the earth which has the function of spacer for clamping the glass plate 1; and bolts 22 and nuts 23. A spacer 24 for both sides is connected.

As it is clear from the first to third embodiments, the sectional assembly has minimum unit of two glass plates connected with the curved holding arms and one or more sets of the other glass plates and the curved holding arms are arranged.

It is possible to add the other set of the glass plate and the curved holding arms to one of the above-mentioned embodiment. It is also possible to mutually combined two or more embodiments or different embodiments of the unit of the glass plates and the curved holding arms.

The modifications of the embodiments in the combinations will be briefly described.

Figure 13:
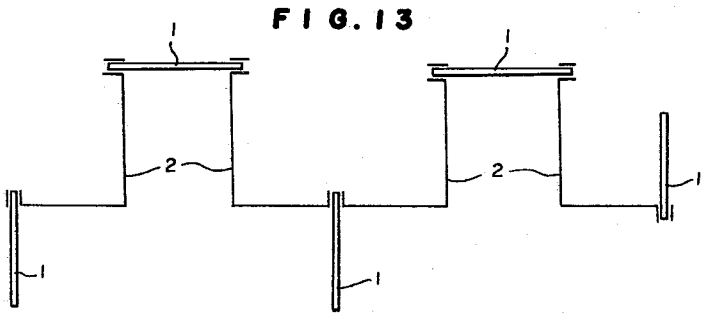

FIG. 13 shows the structure for the parallel connections of the unit of the first embodiments of FIG. 9.

Figure 14:
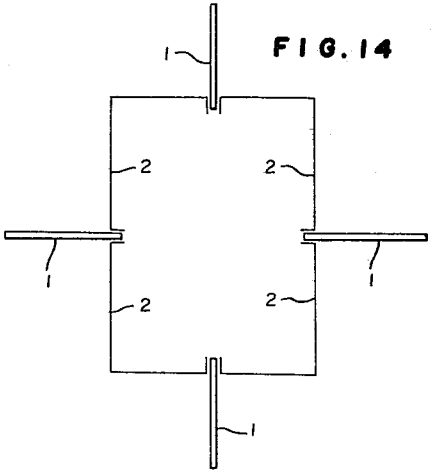

FIG. 14 shows the structure for connecting two units of the second embodiment of FIG. 11 as the linear symmetrical center of the glass plates at both sides.

Figure 15:
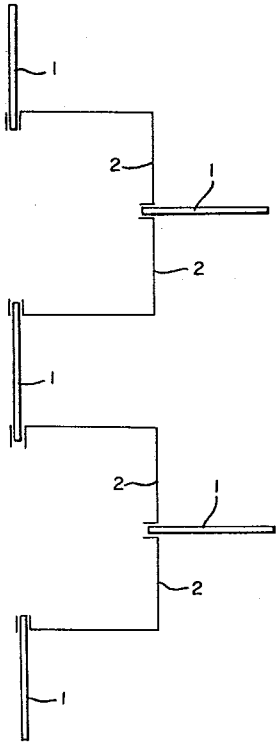

FIG. 15 shows the structure for the connection of two units of FIG. 11 in parallel.

Figure 16:
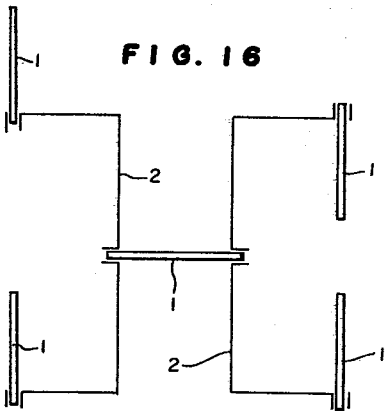

FIG. 16 shows the structure for the connection of two units. FIG. 9 in back to back.

Figure 17:
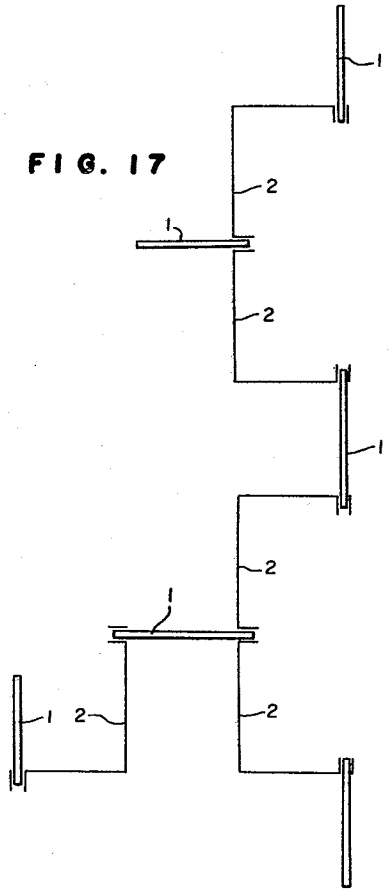

FIG. 17 shows the structure for the connection of two units of FIG. 11 in parallel and on a set of the glass plate and the curved holding arms is connected to the central glass plate.

Figure 18:
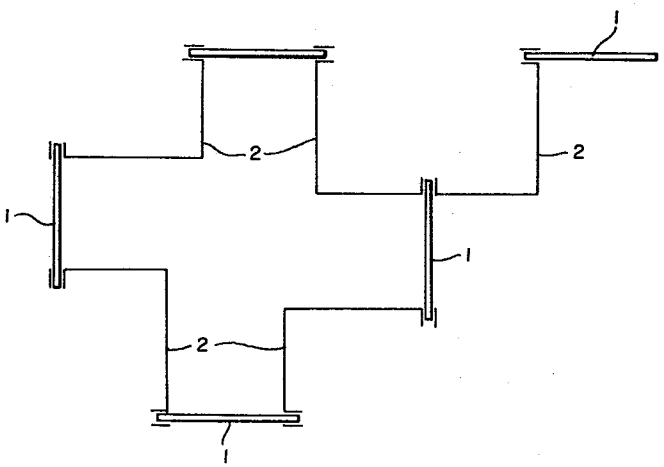

FIG. 18 shows the structure for the addition of one set of the glass plate and the curved holding arms to the unit of FIG. 12.

Figure 19:
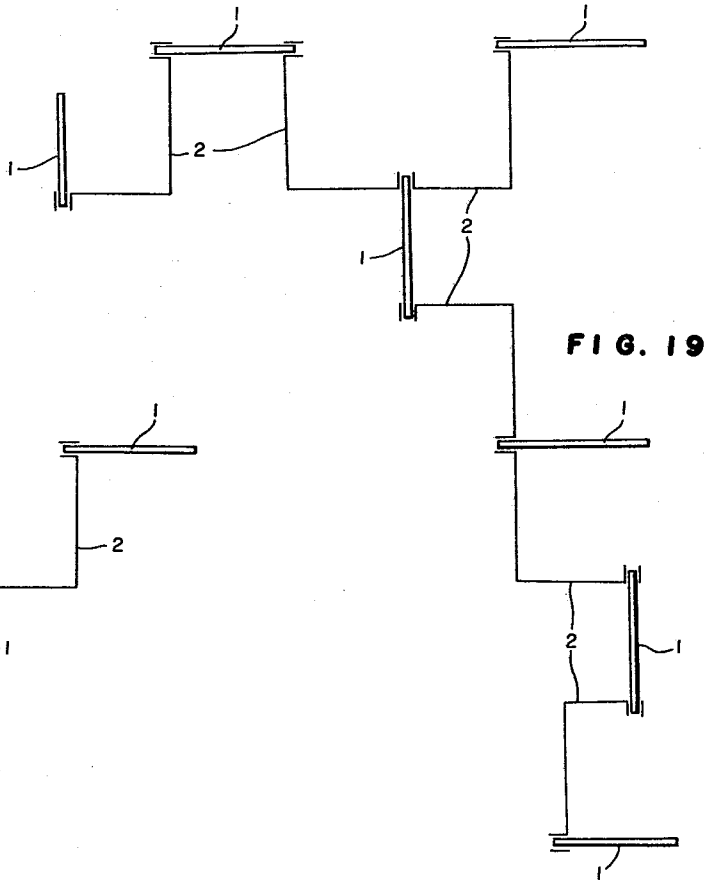

FIG. 19 shows the structure for the connection of three units of FIG. 9.

The curved holding arms used in the embodiments can be a single type shown in FIG. 4 to form desired sectional assembly.

Figure 10:
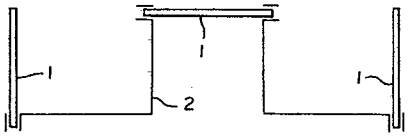

In the embodiment shown in FIG. 10, the connecting part at one end of the curved holding arm is modified to connect the opposite edges of the adjacent glass plates. In detail, the bolts and the nuts are fitted at the part near the curved part of the curved holding arm so as to clamp the glass plate at the end of the arm.

It is possible to arrange the sectional assembly by the combination of the unit (FIG. 4).

In accordance of the sectional assembly for interior article according to the present invention, various types of the combinations of units of single type holding arms and glass plates can be prepared in simple and in speedy and the manufacturing cost of the parts can be remarkably reduced.

What is claimed is:

1. A sectional assembly which comprises:

at least two vertical glass plates, arranged so as to provide a first gap between the said vertical plates, and at least one horizontal plate located adjacent said vertical plates in said gap; and, at least one curved holding element connecting the edges of said vertical plates and supporting said horizontal plate which includes a pair of arms and connecting parts located at each end of said arms, said connecting parts including an end of each arm which is bent so as to form a flange to provide surface contact to said vertical glass plates without forming any holes on said vertical glass plates and including a clamp fitting on said flange.

2. A sectional assembly according to claim 1, wherein:

said clamp fitting is provided with a plurality of holes formed in said fitting and connecting means for securing said clamp fitting to said flange and securing said flange to said vertical glass plates.

3. A sectional assembly according to claim 2, which further comprises:

spacer elements connected to and projecting from said flange so as to control a second gap formed between each of said vertical glass plates and said flange.

4. A sectional assembly according to claim 1, wherein at least three of said vertical plates are connected by more than a pair of said curved holding elements such that at least two of said curved holding elements are secured to one of said vertical plates.

5. A sectional assembly according to claim 1, wherein:

each of said curved holding elements is triangular shaped.

6. A sectional assembly according to claim 1, wherein:

each of said curved holding elements is of a modified L-shape.

7. A sectional assembly according to claim 1, wherein:

each of said curved holding elements further comprises a plurality of hook elements secured to each of said curved holding elements for holding said horizontal plate.

8. A sectional assembly according to claim 1, which further comprises:

a detachable holder element for holding said horizontal plate at a central part of each of said curved holding elements.

9. A sectional assembly according to claim 1, which further comprises:

a protector plate connected at a bottom portion of each of said vertical plates.

10. A sectional assembly according to claim 1, wherein:

said vertical plates are glass plates.

11. A sectional assembly according to claim 7, wherein:

said horizontal plate is a glass plate.

* * * * *